US005936333A

United States Patent [19]

Scherzer

[11] Patent Number: 5,936,333

[45] **Date of Patent: *Aug. 10, 1999**

[54] RADIATION SOURCE WITH HIGH-TEMPERATURE RESISTANT BASE AND CONNECTION TERMINALS, AND METHOD OF ITS MANUFACTURE

[75] Inventor: Joachim Scherzer, Bruchköbel, Germany

[73] Assignee: Heraeus Noblelight GmbH, Hanau, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/864,547

[22] Filed: May 28, 1997

[30] Foreign Application Priority Data

Jul. 25, 1996 [DE] Germany ..... P 196 29 714

[51] Int. Cl.[6] ..... H01J 61/36

[52] U.S. Cl. ..... 313/318.02; 313/318.07; 313/318.08; 439/611; 439/612; 445/23

[58] Field of Search ..... 313/318.02, 318.07, 313/318.08, 318.09, 318.01; 439/611, 612, 613; 445/23, 26, 27

[56] References Cited

U.S. PATENT DOCUMENTS

| | | | |
|---|---|---|---|
| 3,001,096 | 9/1961 | Mosby . | |
| 4,039,886 | 8/1977 | Scherzer . | |
| 5,241,239 | 8/1993 | Rao | 313/318.02 |

FOREIGN PATENT DOCUMENTS

| | | |
|---|---|---|
| 0 070 604 A2 | 1/1983 | European Pat. Off. . |
| 0 345 890 A1 | 12/1989 | European Pat. Off. . |
| 0 547 683 A1 | 6/1993 | European Pat. Off. . |
| 589 724 | 6/1925 | France . |
| 39 34 348 C2 | 4/1991 | Germany . |
| 43 40 995 A1 | 6/1995 | Germany . |
| 976 445 | 11/1964 | United Kingdom . |
| 2 062 957 | 5/1981 | United Kingdom . |
| 2 120 841 | 12/1983 | United Kingdom . |
| 2 120 842 | 12/1983 | United Kingdom . |

*Primary Examiner*—Nimeshkumar D. Patel
*Attorney, Agent, or Firm*—Frishauf, Holtz, Goodman, Langer & Chick, P.C.

[57] ABSTRACT

To provide a easily manufactured high-temperature connection between a pinch-sealed end of a tubular radiator and a base, without requiring cement, the pinch-sealed end has a projecting lead (9) which is fitted into, or against, a projecting end portion (11", 12") of a terminal (11, 12) with a headed outer end (11', 12'); the lead, and the projecting portion of the terminal are securely electrically and mechanically connected within a longitudinal opening (15', 16') of the base (15, 16). This connection can be effected by forming a lateral opening (19, 19') in the base in a region of engagement, or overlap of the lead (9, 10) and the projecting portion (11", 12"), and introducing energy from one side, e.g., by laser welding, or from both sides, e.g., by spot welding, or mechanical compression of the lead (9, 10), and the extending portion (11", 12") of the terminal. The base is held in position by engagement against the pinch or press seal on one side, and, on the other, against the headed end (11', 12') of the connecting terminal (11, 12).

13 Claims, 2 Drawing Sheets

RADIATION SOURCE WITH HIGH-TEMPERATURE RESISTANT BASE AND CONNECTION TERMINALS, AND METHOD OF ITS MANUFACTURE

Reference to related patents, the disclosures of which are hereby incorporated by reference:

U.S. Pat. No. 4,039,886, Scherzer, assigned to a related company of the assignee of this application;

U.S. Pat. No. 3,001,096, Mosby.

Reference to related patent publications:

German 43 40 995 A1, Dieudonne et al, assigned to the assignee of the present application;

German 39 34 348 C2, Bernd et al, assigned to a related company of the assignee of the present application;

British 2,062,957 A; Siaens et al;

British Patent 976,445.

FIELD OF THE INVENTION.

The present invention relates to a radiation source, and more particularly to a radiation source having a tubular bulb of quartz glass of at least one base, and in which a radiation generating space is defined between two oppositely located connection pins for energy supply to the radiation source; and to a method of making terminal connections to the connecting leads. The quartz glass bulb is pinch-sealed at its opposite ends and connected to external current supply leads which are retained 10 within the at least one base.

BACKGROUND

U.S. Pat. No. 4,039,886, Scherzer, assigned to a related company of the assignee of the present application, describes a contact pin insulation of terminal connectors for infrared radiators. The base is formed as a sleeve surrounding the contact pin. The inner surface of the insulation sleeve, which is made of plastic material, is formed with recesses or projections, respectively, for interengagement of the terminal contact with the insulation sleeve. When the temperature of operation becomes very high, plastics used as insulation sleeves have problems with respect to temperature resistance, and long-term stability, so that such sleeves are not suitable for radiators operating at high temperatures.

It has been proposed, see German 43 40 995 A1, Dieudonné et al. assigned to a related company of the present application, to protect pinch or press ends of radiators by plastic sleeves which can be slid on the pinch seals. Such plastic sleeves are not suitable for radiators operating at high temperatures, since long-term stability is a problem. This is particularly so if the radiators are mercury arc high-pressure discharge lamps.

German 39 34 348 C2, Bernd Ullrich et al, describes an electrical discharge lamp with a tubular bulb of quartz glass. Axially oppositely located electrodes are pinch-sealed through the lamp bulb. A base is fitted on the pinch-sealed ends of the bulb. The base is made of electrically insulating material, shaped as a hollow cylinder with two oppositely located slit-shaped recesses or cuts to receive the flat ends of the pinch seal. The base has a through-opening or slit in which contact springs are located. The outer edges of the contact springs are secured in groove-shaped inner edges of a rectangular enlargement and retained by spring action. Manufacture of such a lamp and the bases therefor is comparatively complex and expensive and, further, requires shaping of the external contact terminals to cooperate with external contact springs.

SUMMARY OF THE INVENTION

It is an object to provide a radiation source and base with connecting terminals which have long-time stability, permits use of high-temperature resistant insulation of the base and the terminals therefor, and wherein the base is particularly suitable for insulation of connecting terminals of high-pressure discharge lamps, such as mercury or metal-halide discharge lamps; and to provide a simple and reliable, and readily automated manufacturing process for assembly of a base and a contact terminal or contact terminals therein.

Briefly, the base is a sleeve, fitted on a pinch seal formed on the usually tubular discharge vessel, and made of ceramic material. The base is held in position by an expanded head region of the connecting contact on the pinch seal of the bulb and a connecting electrode lead extending from the lamp. The base terminal has an internally directed end which is electrically and mechanically securely connected, within an axially extending opening in the ceramic base to the connecting lead.

In accordance with a feature of the invention, the base sleeve is formed with a laterally extending hole or aperture which terminates inside the base in a region where both the connecting lead from the lamp and an internally extending portion of the base terminal meet, or preferably, overlap or telescopically interfit. The laterally extending opening permits securing the lead and the terminal extension together, for example by laser welding.

In accordance with a preferred feature of the invention, the inner electrodes of a double-ended lamp are electrically connected to the connecting leads by molybdenum foils. The connecting leads extending from the molybdenum foil, in turn, are connected, within the base sleeves, with the ends or projecting end portions of the base terminals, to form both an electrically and mechanically secure interconnection. The lateral opening permits supply of energy to interconnect the terminal extension and the connecting lead.

The base sleeve has a slit-shaped opening in the end adjacent the pinch-sealed region of the radiator bulb to receive the end of the pinch-sealed region which forms a sealing region.

The arrangement has the specific advantage that it is readily adapted to be used with various types of connecting terminals or contacts, which can be easily arranged on a standard base sleeve, so that a standard sleeve base can be used with different types of sockets.

The radiators can be of any type, for example in the form of discharge lamps, in which electrode pins extend interiorly of a discharge space defined by the bulb; or, alternatively, the radiator may have a radiation source in the form of an axially extending filament which is connected at its ends with the inner terminals of the connecting leads or, respectively, connecting leads from molybdenum foils. This arrangement is particularly suitable for infrared (IR) radiators.

In accordance with a feature of the invention, the method of making the lamp includes the step of first pinch-sealing the ends of at least one end of a tubular bulb, and axially sliding a base sleeve of ceramic material, formed with at least one lateral opening, on the pinch seal. The base sleeve is slid on the pinch seal until it engages an abutment or an end of the pinch seal proximate to the bulb portion of the lamp. A terminal connector, with a connecting end, is then introduced into a longitudinal, e.g., axial opening of the sleeve until the terminal end as well as the connecting lead extending from the lamp bulb are both located in the region of the lateral opening. Energy is then supplied to the junction point, preferably a small overlap, or a telescopic interfit, of the connecting lead from the lamp and the connection end from the terminal. The terminal is formed with a headed portion at the outside of the base. Upon joining together the terminal extension and the connecting lead, the sleeve is securely retained on the pinch seal end of the bulb.

It is a specific advantage that the fitting of the insulating ceramic sleeve, the placement of the terminal with its extension end adjacent the lead from the bulb, and securing the lead from the bulb and the terminal extension end, can be easily carried out, and suitably by automated assembly.

Preferably, and in accordance with a feature of the invention, the terminal extension and the connecting lead from the bulb are joined together by laser pulse radiation, through the lateral opening in the base sleeve. Laser pulse radiation has the specific advantage that optimum matching of supplied welding energy to the energy requirement of the weld is easily possible.

It is not necessary to use laser welding; two aligned radial openings may be formed in the base, and oppositely positioned compression stamps can form a secure press connection between the connecting lead from the bulb and the terminal extension; alternatively, pin-like spot-welding electrodes can be inserted through one or two oppositely located opening in the base.

BRIEF DESCRIPTION OF THE DRAWINGS

FIG. 1*b* is a view similar to FIG. 1, but showing the radiator in form of a filamentary lamp, especially suitable for IR radiation;

DETAILED DESCRIPTION

Figure 1A:
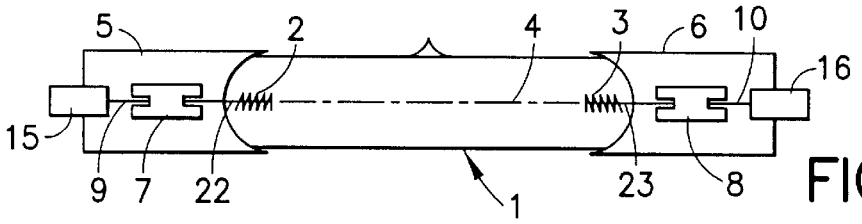
FIG. 1*a* and FIG. 1*b* is a highly schematic longitudinal section illustrating a tubular radiator formed as a discharge lamp, and also suitable for illustrating the respective manufacturing steps.

Referring first to FIG. 1*a:* a discharge lamp has a tubular discharge bulb 1, for example of quartz glass, in which two oppositely located electrodes 2, 3 are positioned, aligned along the axis 4 of the tubular bulb 1. Inner connecting pins 22, 23 support the electrodes 2, 3 (2' in FIG. 1*a*). The electrical connections of the electrodes 2, 3 or, respectively, the connecting pins 22, 23 are connected to molybdenum foils 7, 8, located within pinch or press seals of sealing regions 5, 6. The molybdenum foils 7, 8, located within the pinch seals are electrically connected to outwardly extending connecting leads 9, 10. The leads 9, 10 are mechanically and electrically securely connected to external terminals 11, 12, for example located in line with the bulb axis 4.

In accordance with a feature of the invention, the connecting leads 9, 10 are introduced into a central hollow opening or bore 15' formed in respective bases 15, 16 and positioned at the ends of the bulb 1. The terminals 11, 12 are connected to the leads 9, 10 by welding, to form a secure electrical and mechanical connection. The terminals 11, 12, as well as the outer regions of the pinch seals of the sealing regions 5, 6,-are surrounded by the bases 15, 16 which form base sleeves. The base sleeves 15, 16 have a radially extending slit 18 in which the outer portions of the pinch seals, or of the sealing regions 5, 6, respectively, extend.

In accordance with a feature of the invention, the base seals 15, 16 are fitted on the pinch seals or pinch regions 5, 6, without the usual cement and, rather, retaining the sleeves 15, 16 on the pinch seal ends by the weld connection between the connecting leads 9, 10 and the terminals 11, 12, respectively. To provide for secure retention of the bases 15, 16, the terminals 11, 12 are headed, or formed with a radially extending end button 11', 12', have a widened profile. The respective base sleeve 15, 16, then is securely retained in the region of the pinch seal 5, 6 and, due to the slit 18, secured against rotation. The electrical and mechanical connection between the leads 9, 10, and the outer terminals 11, 12, preferably is done by laser welding, or by resistance welding or spot welding.

In order to permit connection of an extending portion 11", 12" on the terminal 11, 12, with the connecting leads 9, 10, the base sleeve 15, 16 is formed with a laterally extending opening or duct 19 (see FIG. 2) to permit application of a laser pulse. If the connection is to be made by spot welding, the respective base sleeve 15, 16 is formed with two aligned radial openings 19', see FIG. 3, through which pin-like welding electrodes can be introduced, to form a reliable electrically and mechanically secure connection between the connecting leads 9, 10 and the outer terminals 11, 12. Preferably, the bases 15, 16 are formed with an internal shoulder 27, 28 against which the headed portion 11', 12' of the terminal 11, 12 can bear, if the respective socket with which the lamp is to be used, has an appropriate terminal to engage within the recess terminated by the shoulder 27, 28. As can readily be seen, the base sleeve has an abutment surface 25, 26 against which the end of the pinch and press seal can bear so that, upon interconnection of the lead 9, 10 with the extending portion 11", 12" of the terminal, the base sleeve 15, 16 is securely held in position.

Figure 2:
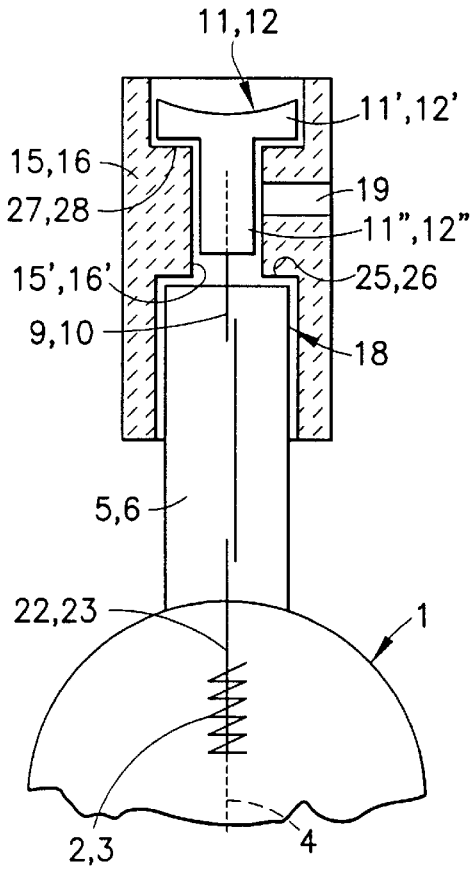
FIG. 2 is a fragmentary, enlarged cross section of an end portion of a radiator and illustrating the pinch or press seal, the radiator contact lead and insulating sleeve; the section is in a plane perpendicular to FIG. 1*a;*
Figure 3:
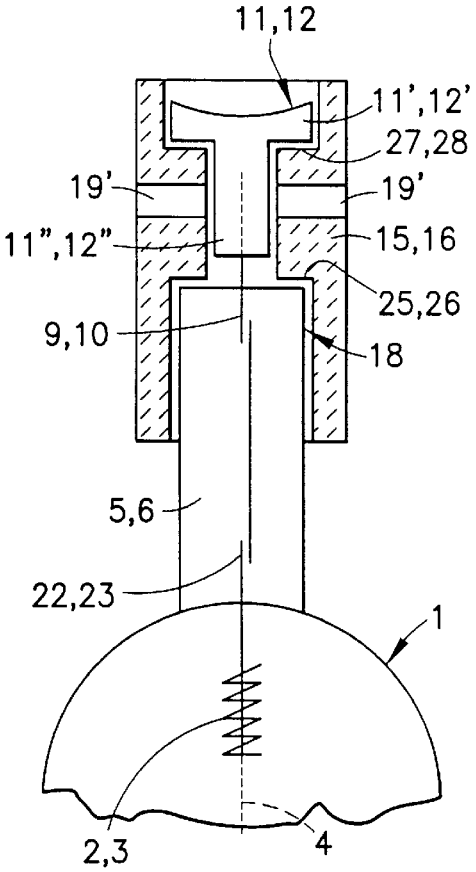
FIG. 3 is similar to FIG. 2, but shows a base suitable for connecting the lamp lead to the terminal by resistance welding or spot welding.

In accordance with a feature of the invention, the application, and electrical and mechanical connection of the bases 11, 12 to the lamp 1, is as follows:

(a) the base sleeves 15, 16 are fitted on the respective ends of the lamp, and at least partly over the pinch seal region 5, 6;

(b) the terminals 11, 12 are placed, with their extensions 11", 12", in the openings 15', 16' of the bases; the leads 9, 10 preferably overlap with, or fit into the extension 11", 12", if the extension is hollow;

(c) the connecting leads 9, 10 and the extensions 11", 12" of the terminal are mechanically and electrically securely connected by supply of energy through the lateral opening 19 (FIG. 2), or both lateral openings 19' (FIG. 3). The diameter of the opening 19, or 19', respectively, is suitably about 1 mm or slightly larger, for example between about 1 and 1.3 mm.

(c-1) a welding pulse, preferably a welding pulse with a solid-state laser through one lateral opening is applied through opening 19;

(c-2) if connection by spot welding is desired, the base sleeve has two openings 19' (FIG. 3), extending in radial direction, and step (c-1) above is then changed by introducing electrodes in a direction perpendicular to the axis 4 of the lamp, through the respective openings 19' to effect a resistance weld connection between the respective lead 9, 10 and the terminal 11, 12.

(c-3) two pin-like pressure stamp dies cab be applied through holes 19' against overlapping portions of the terminal ends 11", 12" which are hollow, and to place the connecting leads 9, 10 into the hollow extensions. A compressive force is applied against the connection on the pressure dies through the openings 19', and an interengaging secure electrical and mechanical connection is formed between the connecting leads 9, 10 and the terminals 11, 12. The base 15, 16 has the form shown in FIG. 3.

FIG. 2 illustrates the radial opening 19 extending only from one side of a sleeve 15, 16, suitable for laser pulse welding; FIG. 3 shows a through openings 19', or, respectively, two openings 19' extending in alignment, in radial direction, so that, for example, two electrodes of a spot welding machine can be introduced through the respective openings 19'.

As seen in FIG. 2, the electrically insulating sleeve 15, 16 has an externally radially enlarged cross-section, which retains the headed end 11', 12' of the respective terminal 11, 12 in axial direction; the slit 18 restrains relative rotation between the respective base and the lamp bulb. Thus, it is not necessary to use an attaching cement, which greatly enhances the temperature range of operation of the lamp.

The base sleeves are made of ceramic material; aluminum oxide has been found to be particularly suitable for the ceramic; other high thermally resistant electrically insulating materials, such as steatite, may also be used.

The slit 18 of the electrically insulated sleeve is so arranged in the sleeve that the pinch-sealed end regions 5, 6 of the lamp extends into the slit, to thereby restrain relative rotation between bulb and base.

FIG. 2 illustrates a preferred arrangement of the lamp for laser welding of the respective lead 9, 10 with the terminal 11, 12. FIG. 3 illustrates the arrangement when spot welding is intended to be used. The radially extending openings 19' are particularly suitable for welding by two counter-directed electrodes. Two welding electrodes, not shown, are moved through the openings 19' in opposite direction towards the axis 4 of the lamp; by resistance welding, an electrically conductive and mechanically secure connection is then formed between the inner terminal projections 11", 12" of the terminals 11, 12 and the respective connecting lead 9, 10.

Figure 1B:
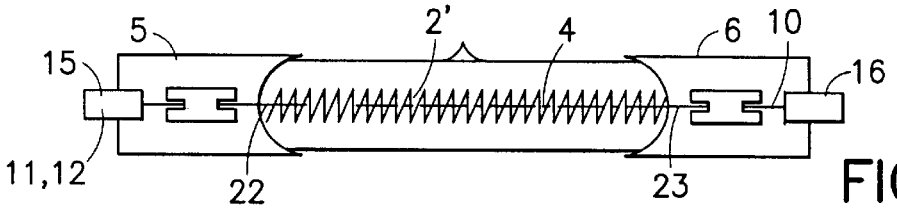
Figure 4A:
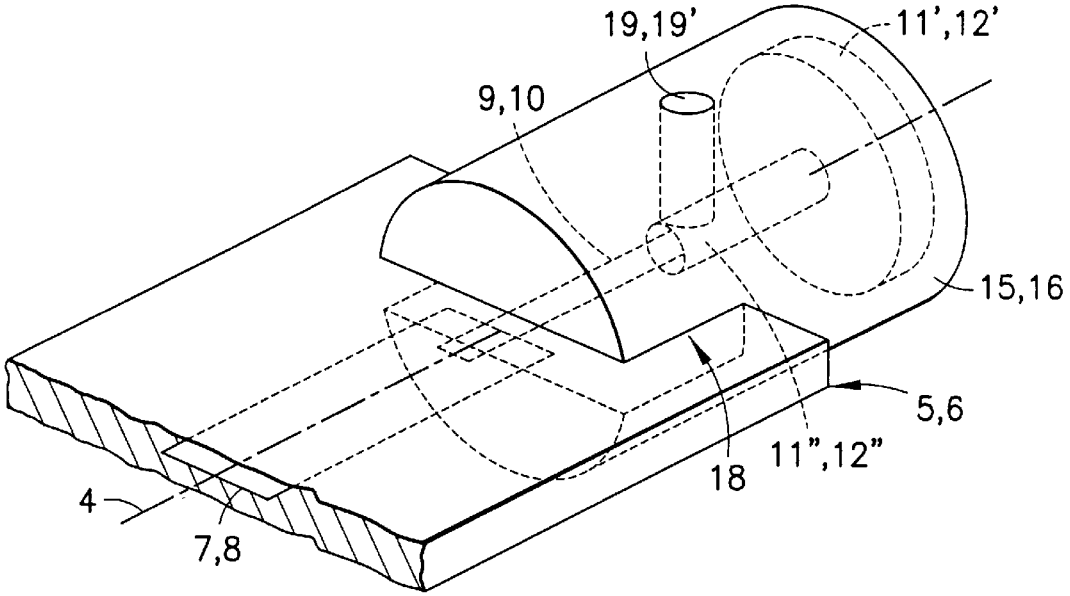
FIG. 4*a* is a fragmentary perspective view of a pinch seal with a ceramic sleeve attached thereto.

FIG. 1*a* is a view similar to FIG. 1; the lamp, however, does not have discharge electrodes 2, 3 but, rather, a filament 2' extending between the internal leads 22, 23. FIG. 4*a* is a perspective, schematic view of a portion of a pinch seal region 5, 6, which is broken away, and showing the molybdenum foil 7, 8 therein. The ceramic base sleeve 15, 16 is fitted over the end portion of the pinch seal region. The connecting lead 9, 10, shown in broken lines, is fitted within a sleeve-like extension 11", 12" of the terminal 11, 12, which is formed with a radially extending head 11', 12'. The sleeve-like extension 11", 12" extends along the axis 4 of the lamp. The extension 11", 12" and the connecting lead 9, 10 are electrically conductively and mechanically securely connected together, by being welded together, for example by laser welding. If resistance welding is used, two aligned openings 19' (FIG. 3) are to be used, only one of which is visible in FIG. 4*a*. The gap 18 is enlarged only slightly with respect to the end portion 5, 6 of the pinch seal region, just enough that the electrically insulating ceramic sleeve 15, 16 can be easily slid on the ends of the pinch seal. In accordance with the present invention, the connection between base and lamp is cement-less, the base being held on the lamp by the both electrically and mechanically secure connection between the leads 9, 10 and the terminals 11, 12.

Figure 4B:
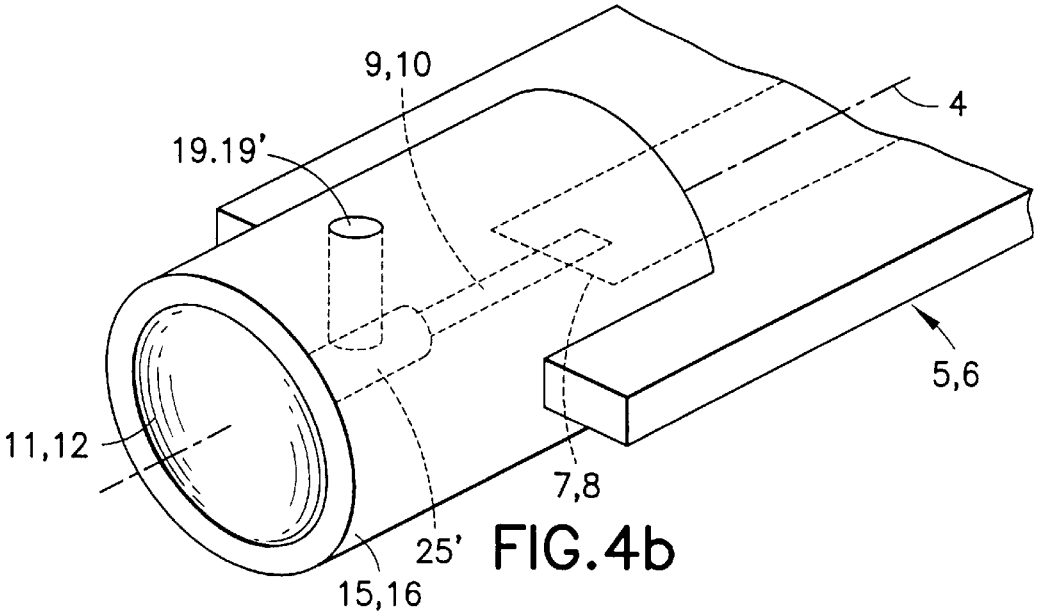
FIG. 4*b* is a perspective view similar to FIG. 4*a*, but reversed with respect to the pinch seal, to illustrate the outer surfaces of the outer terminal and the insulating base sleeve.

FIG. 4*b* is similar to FIG. 4*a*, except that the view is taken from the right side of FIG. 4*a*, that is, the view is reversed with respect to FIG. 4*a*. The ceramic sleeve 15, 16, and the outer terminal 11, 12, with its radial enlargement, is clearly seen; this outer terminal is connected by a weld connection with the electrical connecting leads 9, 10; due to the headed end, or radially directed enlargement of the terminals 11, 12, a shape-interengaging connection of the ceramic sleeve 15, 16 with the lamp will result. The connection between the leads 9, 10 and the terminals 11, 12 is only symbolically shown by point 25', since this connection is not visible in the Figure. The connection point between the pin 9, 10 and molybdenum foil 7, 8 is symbolically shown by the broken lines. The actual contact surfaces of the terminals 11, 12, are slightly concave—see FIGS. 2 and 3—and recessed within the end surface of the respective base sleeve 15, 16. The concave inwardly extending region is preferably symmetrical, and radial with respect to the axis 4. The concave shape of the terminal facilitates proper and aligned seating of the terminals 11, 12 in respective sockets for the discharge lamp.

Various changes and modifications may be made and any features described herein may be used with any of the others, within the scope of the inventive concept.

I claim:

1. A radiation source comprising a tubular transparent bulb (1);

at least one pinch or press seal (5, 6) terminating on at least one end of the tubular bulb;

light-emitting means (2, 3; 2') located with the tubular bulb;

connection means (22, 23; 7, 8) coupled to the light-emitting means, and extending through the at least one pinch or press seal (5, 6);

electrical connection leads (9, 10) projecting from the at least one pinch or press seal;

at least one base (15, 16) formed with at least one longitudinal through-opening (15', 16') therethrough, and mounted on the at least one pinch or press seal; and connection terminals (11, 12) located on the at least one base, wherein the at least one base (15, 16) comprises a ceramic material; and the at least one base (15, 16) has a portion shaped and formed to interlock, or interengage with the at least one press seal (5, 6);

said connection terminals (11, 12) each having an enlarged head portion (11', 12') in engagement with the at least one base (15, 16) and a projecting portion (11", 12") extending into the at least one through opening (15', 16');

a mechanically and electrically secure connection between said projecting portion (11", 12") of said connection terminals (11, 12) and said electrical connection leads (9, 10) within the at least one through opening (15', 16') of the base, wherein the at least one base (15, 16) is formed with a laterally extending opening (19, 19') to permit a supply of energy for formation of said mechanically and electrically secure connection within the base between said protecting portion (11", 12") of the connection terminals (11, 12) and the electrical connection leads (9, 10) and wherein said mechanically and electrically secure connection comprises a laser weld, the laser weld being made by projecting a laser beam through said laterally extending opening (19).

2. The radiation source of claim 1, wherein said base (15, 16) is formed with at least one lateral slit (18) at the end of the base facing the bulb (1), said slit being dimensioned and shaped to receive an end region of the pinch or press seal (5, 6) of the bulb.

3. The radiation source of claim 1, further including molybdenum foils (7, 8) located within said pinch or press seals (5, 6), internally and externally connected with said connection means to, respectively, said light-emitting means (2, 3; 2') and said projecting portions (11", 12") of the connection terminals (11, 12).

4. The radiation source of claim 1, wherein said light-emitting means comprises a pair of electrodes, and said tubular transparent bulb encloses a discharge space.

5. The radiation source of claim 1, wherein said light-emitting means comprises a filament (2').

6. The radiation source of claim 1, wherein said laterally extending opening comprises a through opening (19') extending transversely to an axis (4) of said base.

7. The radiation source of claim 1, wherein said light-emitting means comprises a filament (2').

8. The radiation source of claim 1, wherein said laterally extending opening comprises a through opening (19') extending transversely to an axis (4) of said base, which axis is positioned in axial alignment with said through opening (15', 16').

9. The radiation source of claim 1, wherein said base is formed with at least one lateral slit (18) at the end of the base facing the bulb (1), said slit being dimensioned and shaped to receive an end region of the pinch or press seal (5, 6) of the bulb.

10. The radiation source of claim 1, wherein said light-emitting means comprises a pair of electrodes, and said tubular transparent bulb encloses a discharge space.

11. A method to make a radiation source, comprising:

(a) providing a tubular transparent bulb (1) formed with at least one pinch or press seal (5, 6) at an end of the tubular transparent bulb, said tubular transparent bulb having light-emitting means located therein, and having electrical connection leads (9, 10) coupled to the light-emitting means and projecting from at least one of the pinch or press seals;

(b) providing at least one base (15, 16) of electrically insulating ceramic material, and formed with a longitudinally extending through-opening (15', 16') therein, said at least one base (15, 16) being formed with at least one laterally extending opening (19, 19') intermediate its axial length, and communicating with said longitudinal through-opening (15', 16');

(c) providing at least one connection terminal (11, 12) formed with a headed or enlarged head portion (11', 12'); wherein said connection terminal has a projecting portion (11", 12");

(d) fitting said base axially on the lamp until the base engages the pinch or press seal (5, 6);

(e) axially introducing at least one connection terminal (11, 12) into the longitudinal opening of the base until the headed end portion (11', 12') engages a surface of the base remote from its engagement with the pinch seal, and the projecting portion and a connection lead (9, 10) from said bulb are located in the region of said laterally extending opening;

(f) introducing laser pulse energy through said at least one laterally extending opening (19, 19') and thereby forming a weld for welding said connection lead (9, 10) and projecting portion (11', 12') of the connection terminal together, said laser pulse energy being introduced according to the laser energy requirement of the weld and (g) securely mechanically and electrically interconnecting the projecting portion (11", 12") of the at least one connection terminal (11, 12) with the at least one electrical connection lead (9, 10) within the longitudinal through-opening of the base.

12. The method of claim 11, wherein said laterally extending opening (19')extends transversely through said base (15, 16) and intersects the longitudinal through-opening (15', 16').

13. The method of claim 11, wherein said projecting portion (11", 12") is hollow, and said step of fitting said at least one connection terminal into the longitudinal opening additionally comprises the step of fitting the projecting portion (11", 12") over the at least one electrical connection lead (9, 10);

said laterally extending opening is a through opening (19') extending transversely through said at least one base and intersecting the longitudinal opening (15', 16') thereof.

* * * * *